US005697530A

United States Patent [19]

Montaner et al.

[11] Patent Number: 5,697,530

[45] Date of Patent: Dec. 16, 1997

[54] PRECOMPRESSION PUMP SPRAYER

[75] Inventors: Pedro Parés Montaner; Manuel Romaguera Monegal, both of Barcelona, Spain

[73] Assignee: Monturas, S.A., Barcelona, Spain

[21] Appl. No.: 591,971

[22] Filed: Jan. 29, 1996

[51] Int. Cl.[6] ..... B65D 88/54

[52] U.S. Cl. ..... 222/321.2

[58] Field of Search ..... 222/321.2, 375

[56] References Cited

U.S. PATENT DOCUMENTS

| | | |
|---|---|---|
| 3,774,849 | 11/1973 | Boris . |
| 4,061,247 | 12/1977 | Meshberg . |
| 4,140,249 | 2/1979 | Majima . |
| 4,591,076 | 5/1986 | Iizuka . |
| 4,607,765 | 8/1986 | Ruscitti . |
| 4,856,677 | 8/1989 | Brunet et al. . |
| 4,941,595 | 7/1990 | Montaner et al. . |
| 4,991,746 | 2/1991 | Schultz . |
| 5,064,105 | 11/1991 | Montaner . |
| 5,388,766 | 2/1995 | Buisson . |

FOREIGN PATENT DOCUMENTS

WO 93/13873 7/1993 WIPO .

*Primary Examiner*—Gregory L. Huson

*Attorney, Agent, or Firm*—Watson Cole Stevens Davis, P.L.L.C.

[57] ABSTRACT

A precompression pump sprayer of the type having main and secondary pump cylinders and pistons have a two-piece main piston assembly comprising a separate piston sleeve element of molded compliant material and a hollow piston stem of molded rigid material affixed thereto. The more rigid stem permits a reduction in its overall height and overall diameter, resulting in a reduction of the overall height of the pump sprayer. The cylinder has an extension in frictional engagement with the separate sleeve element of the main piston assembly for fixing the secondary cylinder thereto.

9 Claims, 1 Drawing Sheet

PRECOMPRESSION PUMP SPRAYER

BACKGROUND OF THE INVENTION

This invention relates generally to a precompression pump sprayer which relies on a build-up of hydraulic pressure within a main pump cylinder for shifting open a discharge poppet valve when that pressure exceeds the force of a poppet closing spring to open the discharge, permitting the spray discharge of product under pressure and the abrupt closing of the discharge when the force of the poppet closing spring exceeds the built-up pressure. A precompression pump sprayer of this general type is disclosed is U.S. Pat. No. 4,941,595, commonly owned herewith, and the present invention represents an improvement thereon.

There is a need in especially the fragrance market to provide a smaller dispensing package which requires the overall length of the pump sprayer to be made shorter, i.e., the distance between the top of the bottle neck from which the pump sprayer extends, and the top of the plunger cap against which downward pressure is applied by the operator, should be as short as possible. And, to improve the overall appearance of the dispensing package, the portion of the pump sprayer extending into the bottle neck should be as short as possible since the main pump cylinder is preferred to be hidden within the bottle neck.

The pump sprayer according to the U.S. Pat. No. 4,941,595 has a one-piece main piston of molded, compliant material such as polyethylene or the like, requiring a relatively long piston stem having an enlarged outer diameter to withstand the downward external forces, during pumping, applied by the operator to the plunger head mounted on the upper free end of the piston stem.

Moreover, the U.S. Pat. No. 4,941,595 sprayer requires a flange fitment coupled to the upper free end of the main pump cylinder to facilitate mounting the pump sprayer to a container using a closure cap of some type. The flange fitment has a central opening through which the piston stem extends and with which an external conical section of the stem engages in the inactive position of the pump for sealing a container vent passage closed. And, the flange fitment is of a molded rigid material such as polyethylene or the like, providing a tight seal with the piston stem of molded compliant material such as polyethylene. This arrangement adds to the overall height of that portion of the pump sprayer which extends above the top of the container neck.

SUMMARY OF THE INVENTION

It is therefore an object of the present invention to provide a precompression pump sprayer which functions in essentially the same manner as in the prior U.S. Pat. No. 4,941,595 patent but which is structured as having a relatively short main piston stem extending above the container closure to thereby effect an overall relatively shorter pump sprayer which also permits its main pump cylinder to be contained within the container neck.

In accordance with the invention, this objective is achieved by the provision of a two-piece main piston assembly comprising a separate piston in the form of a sleeve element of molded compliant material which operates in a main pump cylinder, and a hollow piston stem of molded rigid material having a first portion extending into the sleeve for fixedly mounting the parts of the assembly together. A secondary cylinder is frictionally interconnected with the sleeve element by the provision of an extension projecting into a cavity of the sleeve element opening into the pump chamber. The main piston assembly has a discharge valve seat therein for sealing engagement by a spring biased poppet valve extending from a secondary pump piston within the secondary cylinder.

The primary piston stem has an external flange overlying the main piston sleeve element and underlying a crown portion of a crimp ferrule coupled directly to the main pump cylinder for mounting the pump sprayer to the neck of the container of product to be sprayed. A container vent passage is defined between the interior and exterior of the ferrule and is sealed closed in the inactive position of the pump sprayer by the provision of a seal gasket on the piston stem flange.

Other objects, advantages, and novel features of the invention will become more apparent from the following detailed description of the invention when taken in conjunction with the accompanying drawings.

DETAILED DESCRIPTION OF THE INVENTION

Figure 1:
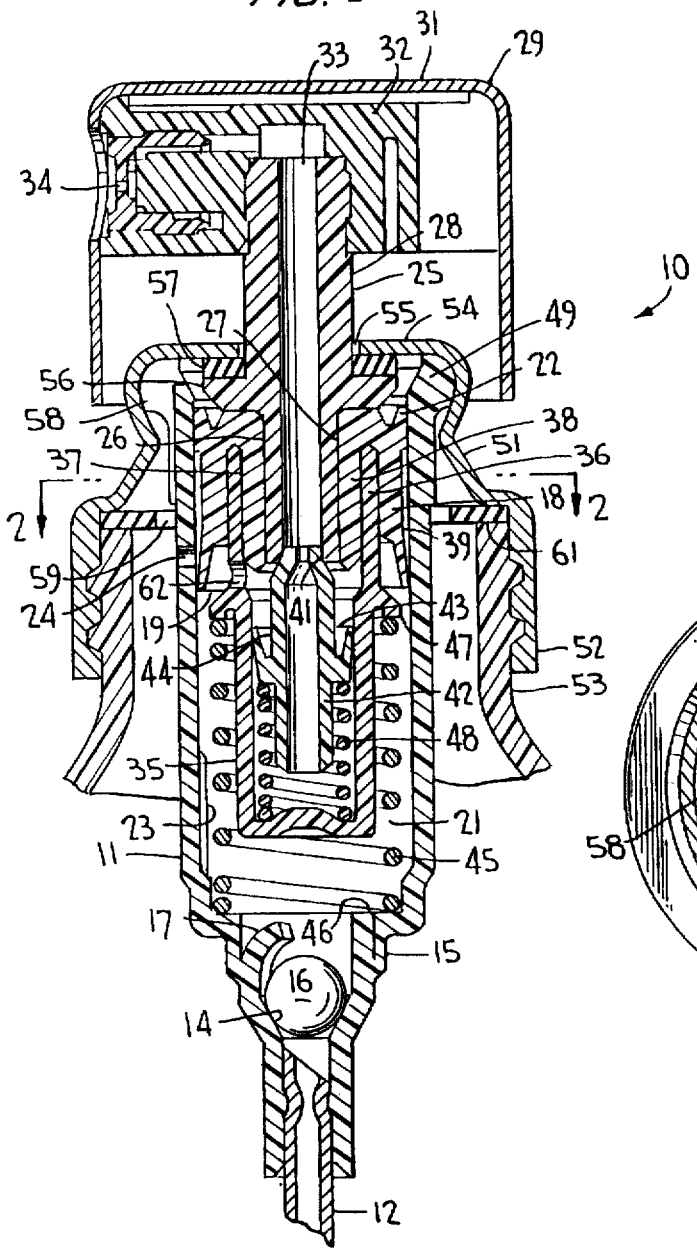
FIG. 1 is a vertical sectional view of the precompression pump sprayer according to the invention shown in relation to the neck of the container on which the pump sprayer is to be mounted.

Turning now to the drawings wherein like reference characters refer to like and corresponding parts throughout the several views, the precompression pump sprayer according to the invention is generally designated 10 in FIG. 1 as comprising a main pump cylinder 11 suspending in known manner a dip tube 12 extending into container 13 of liquid product to be sprayed. An inlet valve seat 14 is formed within throat 15 at the lower end of the cylinder for the reception of an inlet ball check valve 16, fingers 17 molded into the throat overlying the ball valve in spaced relation to thereby define a ball valve cage.

A main piston assembly comprises a separate piston sleeve element 18 of molded compliant material such as polyethylene or the like having a lower piston seal 19 in sliding sealing engagement with the inner wall of the pump cylinder for therewith defining a variable volume pump chamber 21. An axially spaced upper seal 22 on element 18 is likewise in sliding sealing engagement with the wall of cylinder 11 for preventing blow-by past the piston when at the end of the piston stroke, the sealing engagement of piston seal 19 with the wall of the cylinder is broken as it distorts when engaging a priming rib 23 for expelling unwanted air from pump chamber 21 into the container via a side opening 24, in a manner known in the art. In lieu of priming rib 22 a priming groove (not shown) may be provided, or a grooved protuberance such as that disclosed at 30 in U.S. Pat. No. 5,064,105, commonly owned therewith, to effect priming.

The main piston assembly further comprises a hollow piston stem 25 of molded rigid material such as polypropylene or the like, having a first portion 26 extending into central opening 27 of the sleeve element in tight frictional engagement with the surface forming that opening for fixedly interconnecting the piston sleeve element and piston stem element together as an assembly.

A second portion 28 of the piston stem extends outwardly of the upper end of the main pump cylinder and is fixedly mounted to a plunger head assembly 29 which may include a separate plunger cap 31 containing spray means 32 of known construction. The hollow piston stem defines a discharge passage 33 communicating with a discharge orifice 34 of spray means 32, through which liquid is discharged during pumping in the form of a fine mist spray.

The pump sprayer further includes a secondary cylinder 35 within the main cylinder, the secondary cylinder having an upward extension 36 projecting into a cavity 37 formed in element 18 and opening into pump chamber 23.

Extension 36 may be in the form of an annular tube (FIG. 2) and the cavity may be in the form of an annular groove having opposed surfaces with which extension 36 frictionally engages for fixedly mounting the secondary cylinder with sleeve element 18 of the main piston assembly. Otherwise, extension 36 may be in the form of a plurality of spaced, elongated fingers (not shown) projecting into the cavity formed of a plurality of correspondingly shaped depressions having opposed surfaces with which the fingers frictionally engage.

In that embodiment wherein cavity 37 is in the form of an annular groove, such groove defines spaced inner and outer skirts 38, 39 having opposed surfaces with which tubular extension 36 engages.

The lower end of the main piston assembly has a discharge valve seat 41 therein which, as shown in FIG. 1, may be defined at the lower end of piston stem 25. Otherwise, the lower end of the piston stem can be recessed within sleeve element 18 such that the lower end of inner skirt 38 defines the discharge valve seat, without departing from the invention.

A secondary piston 42 is housed within the secondary cylinder, and has an upwardly directed piston seal 43 for sliding sealing engagement with the inner wall of the secondary cylinder. The secondary piston likewise has an upstanding poppet valve 44 with a conical free end forming a discharge valve seated against discharge valve seat 41 in the inactive position of the pump shown in FIG. 1. The secondary piston may be hollow throughout its entire extent to facilitate the egress of any air from within the secondary cylinder which would otherwise interfere with the reciprocating movement of the secondary piston.

A main piston return spring 45 is housed within the pump chamber extending between a lower shoulder 46 of the main cylinder and a transversely extending flange 47 of the secondary cylinder. And, a secondary piston return spring 48 is housed within the cup-shaped secondary cylinder extending between the bottom wall thereof and a shoulder underlying piston seal 43 as shown, for spring biasing the popper valve into its discharge valve closing position as shown.

The upper end of the main pump cylinder is provided with an external bead 49 to facilitate mounting the pump sprayer on the container as by the provision of a crimp ferrule 51 which is crimped in any normal manner about bead 49, the ferrule having a skirt 52 to be crimped about one or more corrugations 53 provided on neck 53 of the container.

The ferrule has an upper flat crown 54 with an enlarged central opening 55 through which second portion 28 of the main piston stem extends. Crown 54 overlies a transversely extending flange 56 of the main piston stem, which flange bears against the upper wall of sleeve element 18. Flange 56 has secured thereto a gasket seal 57 in tight sealing engagement with the underside of crown 54 to define a limit stop for the piston assembly in the inactive position of the pump sprayer shown in FIG. 1.

Figure 2:
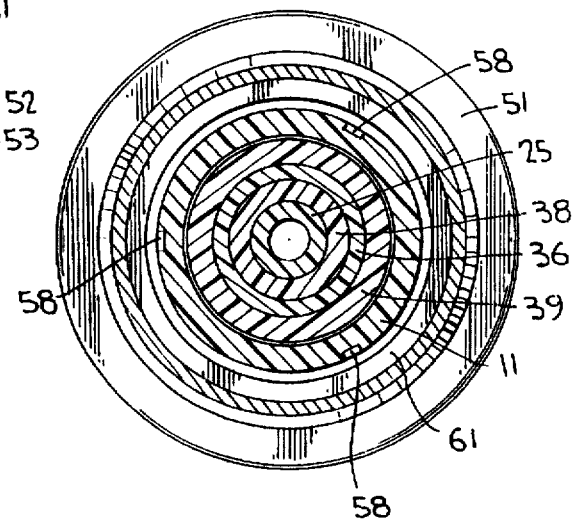
FIG. 2 is a sectional view taken substantially along the line 2—2 of FIG. 1.

Bead 49 of the main pump cylinder has at least one vertical groove 58 therein (three are shown in FIG. 2) establishing a portion of a vent passage in communication with the interior of the container via an enlarged central opening 59 of a container gasket seal 61. During pumping, the main piston and stem are lowered, whereupon gasket seal 57 moves away from the underside of crown 54 for opening the vent passage to atmosphere via the enlarged central opening 55 of the ferrule. Thus, the liquid product suctioned from the container into the pump chamber during pump operation is replaced by air to avoid hydraulic lock and container collapse. At the end of each piston suction stroke, the vent passage is sealed closed by gasket seal 57.

Pump operation is essentially the same as that described in the U.S. Pat. No. 4,941,595, such that with pump chamber 21 fully primed, external downward force applied by the operator to the plunger head effects reciprocation of the main piston and, upon a build-up of pressure within the pump chamber which pressure communicates with the secondary piston via one or more side openings 62 located in the secondary cylinder, causes the secondary piston to reciprocate downwardly when the hydraulic pressure exceeds the force of spring 48 to thereby open the discharge valve, permitting the discharge of liquid under pressure through the discharge orifice as a fine mist spray. When the hydraulic pump pressure is overcome by the force of secondary return spring 48, the poppet valve reseats, closing the discharge without the formation of dribbles and drips at the discharge orifice. During each suction stroke of the main piston, product is inletted from the container into the main pump chamber via the unseated inlet valve 16.

The main piston assembly, comprising a piston stem of molded rigid material and a separate piston element of molded compliant material, allows for a shorter and reduced diameter piston stem second portion 28, thereby reducing the overall height of the pump sprayer while permitting a comparable output similar to that of the U.S. Pat. No. 4,941,595 pump sprayer. The container vent control is improved as the main piston stem of more rigid material seals against the underside of the ferrule crown in a lapped wall relationship presenting a tighter seal compared to a conical wall seal of the type provided for the '595 pump sprayer. Thus, the flange fitment normally required for that sprayer is eliminated, and the main pump cylinder is directly crimped onto the bottle, which likewise tends to reduce the overall height of the pump sprayer.

Obviously, many modifications and variations of the present invention are made possible in the light of the above teachings. It is therefore to be understood that within the scope of the appended claims the invention may be practiced otherwise than as specifically described.

What is claimed is:

1. A precompression pump sprayer, comprising, a main piston assembly reciprocable within a main cylinder between an inactive position and an end-of-stroke position to therewith define a variable volume pump chamber, said main piston assembly comprising a separate piston sleeve element of molded compliant material having a central bore and a cavity opening toward said chamber, and a hollow piston stem of molded rigid material having a first portion extending into said bore in tight frictional engagement with a surface of said bore for fixedly interconnecting said stem and said sleeve element together, said cavity defining a pair of spaced opposed surfaces, said main piston assembly having a discharge valve seat therein, a piston return spring urging said main piston means toward the inactive position, a secondary cup-shaped cylinder within said main cylinder, said secondary cylinder having an extension in tight frictional engagement with said opposed surfaces of said cavity for fixedly mounting said secondary cylinder to said main piston assembly, a secondary piston reciprocable within said secondary cylinder and having a poppet stem in engagement with said valve seat in a discharge valve closing position under the bias of a secondary spring within said secondary cylinder, and said secondary cylinder having at least one transverse opening to establish communication between said pump chamber and said secondary piston.

2. The pump sprayer according to claim 1, wherein a distal end of said piston stem confronting said pump chamber defines said valve seat.

3. The pump sprayer according to claim 1, wherein said extension is tubular.

4. The pump sprayer according to claim 1, wherein a second portion of said piston stem extends outwardly through an open end of said main cylinder, a container closure cap provided for mounting the pump sprayer to a container of liquid product to be sprayed, said closure cap comprising a crimp ferrule in crimped engagement with said open end said main cylinder.

5. The pump sprayer according to claim 4, wherein said ferrule has a crown wall overlying said sleeve element, said wall having a central opening through which said piston stem extends.

6. The pump sprayer according to claim 5, wherein said piston stem has an integrally molded transverse external flange in engagement with said sleeve element and underlying said crown wall to provide a limit stop at the piston upstroke position.

7. The pump sprayer according to claim 1, wherein said main cylinder has an external retention bead at an open end thereof, a container closure cap provided for mounting the pump sprayer to a container of liquid product to be sprayed, said cap comprising a crimp ferrule in crimped engagement with said retention bead, a container vent passage in said bead for venting the interior of the container to atmosphere during reciprocation of said piston means via an enlarged central opening located in said cap through which said piston stem extends.

8. The pump sprayer according to claim 7, wherein said piston stem has a transverse external flange underlying a crown wall of said cap containing said central opening, a gasket seal fixed to said flange and sealingly engaging said crown wall for sealing said vent passage closed in the inactive position.

9. The pump sprayer according to claim 1, wherein said extension is tubular, and said cavity of said sleeve element comprises an annular groove defining spaced inner and outer skirts having said opposed surfaces, said tubular extension frictionally engaging said opposed surfaces of said skirts.

* * * * *